US009265309B2

(12) United States Patent
Zannella

(10) Patent No.: US 9,265,309 B2
(45) Date of Patent: Feb. 23, 2016

(54) BRACELET WITH GROOVE FOR HAIR BAND

(71) Applicant: Karin Zannella, Fairfield, CT (US)

(72) Inventor: Karin Zannella, Fairfield, CT (US)

( * ) Notice: Subject to any disclaimer, the term of this patent is extended or adjusted under 35 U.S.C. 154(b) by 76 days.

(21) Appl. No.: 13/675,051

(22) Filed: Nov. 13, 2012

(65) Prior Publication Data

US 2013/0133365 A1 May 30, 2013

Related U.S. Application Data

(60) Provisional application No. 61/564,739, filed on Nov. 29, 2011.

(51) Int. Cl.
*A44C 5/00* (2006.01)
*A41D 20/00* (2006.01)

(52) U.S. Cl.
CPC ..... *A44C 5/0007* (2013.01); *A44C 5/003* (2013.01); *A41D 20/00* (2013.01)

(58) Field of Classification Search
USPC ..... 63/3, 40, 15; 24/3.2; D11/3, 4; 248/682
See application file for complete search history.

(56) References Cited

U.S. PATENT DOCUMENTS

| | | | | |
|---|---|---|---|---|
| 3,559,854 | A * | 2/1971 | Loveland | 224/219 |
| 5,081,852 | A * | 1/1992 | Cox | 63/3 |
| 5,186,186 | A | 2/1993 | Hamilton | |
| 5,829,457 | A * | 11/1998 | Huang | 132/275 |
| 6,276,369 | B1 | 8/2001 | Rogers | |
| 6,880,364 | B1 | 4/2005 | Vidolin | |
| 7,140,063 | B2 | 11/2006 | Osborne | |
| 7,543,460 | B2 | 6/2009 | Cruise | |
| D603,287 | S | 11/2009 | Dzurek | |
| 7,963,289 | B1 * | 6/2011 | King | 132/200 |
| D646,600 | S * | 10/2011 | Minkkinen et al. | D11/3 |
| 2004/0164034 | A1 | 8/2004 | Costanza | |
| 2009/0145454 | A1 | 6/2009 | Saponaro | |
| 2015/0082830 | A1 * | 3/2015 | Ingimundarson | 63/1.11 |

* cited by examiner

*Primary Examiner* — Jack W Lavinder
(74) *Attorney, Agent, or Firm* — Myers Wolin, LLC

(57) ABSTRACT

A bracelet having a channel groove. The bracelet has an outer side and an inner side. A channel groove is at least partially surrounding a circumference of the outer side. A hair band may fit within the channel groove.

5 Claims, 2 Drawing Sheets

BRACELET WITH GROOVE FOR HAIR BAND

BACKGROUND OF THE INVENTION

The present invention relates to a bracelet and, more particularly, to a bracelet with a groove around its circumference.

Hair bands may be used to arrange hair in a propped up position, such as a bun, or ponytail. Currently, a user of a hair band may keep the hair band on the user's wrist. A user may do this for purposes of convenience. For example, when the user wants to prop up their hair, the hair band may be easily accessed.

SUMMARY OF THE INVENTION

However, wearing a hair band around one's wrist may be uncomfortable. The hair band may fit snuggly around the wrist and may thereby cut off circulation. Further, wearing a hair band around one's wrist may be considered unfashionable.

As can be seen, there is a need for a fashionable and comfortable way to wear a hair band around one's wrist.

In one aspect of the present invention, a device worn on a wrist comprises: a bracelet having an outer side and an inner side, wherein said outer side is configured to face away from said wrist and said inner side is configured to face towards said wrist; and a channel groove at least partially surrounding a circumference of said outer side of said bracelet.

In another aspect of the invention, the device may further comprise at least one indent embedded in said outer side of said bracelet and at least partially surrounding said channel groove. In another aspect of the invention, said channel groove is surrounding an entire circumference of said outer side of said bracelet. The device may further comprise a hair band located within said channel groove. In another aspect of the invention, said outer side of said bracelet comprises a plurality of said indents. In another aspect of the invention, said at least one indent is sized to correspond to a human finger. In another aspect of the invention, said at least one indent has an indent depth in said bracelet that is deeper than a groove depth of said channel groove.

These and other features, aspects and advantages of the present invention will become better understood with reference to the following drawings, description and claims.

DETAILED DESCRIPTION OF THE INVENTION

Figure 1:
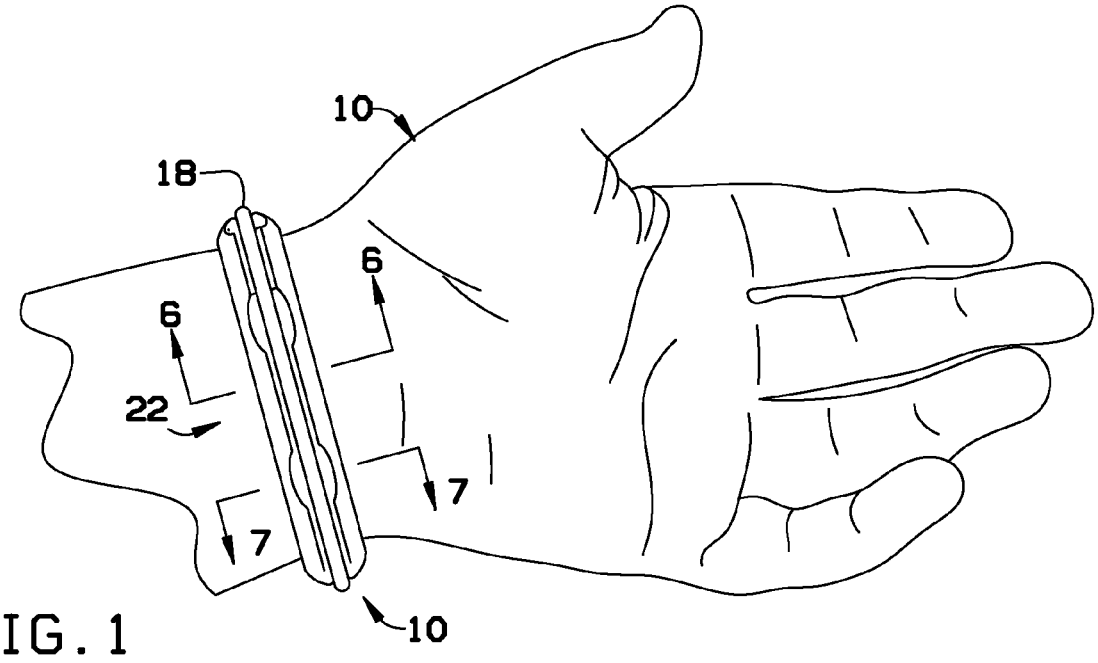
FIG. 1 is a perspective view of the invention shown in use.
Figure 2:
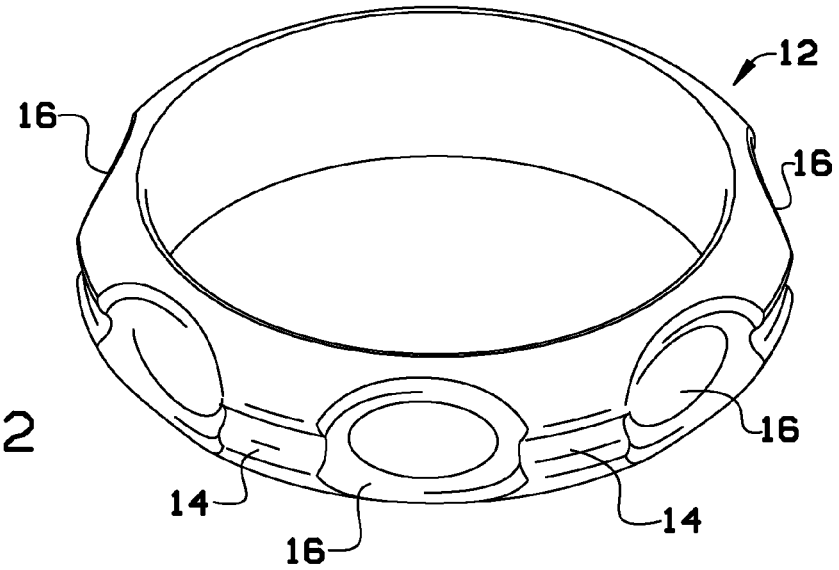
FIG. 2 is a perspective view of the invention.
Figure 3:
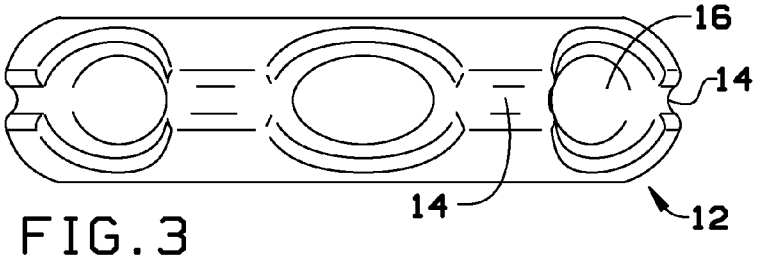
FIG. 3 is a front view of the invention.
Figure 4:
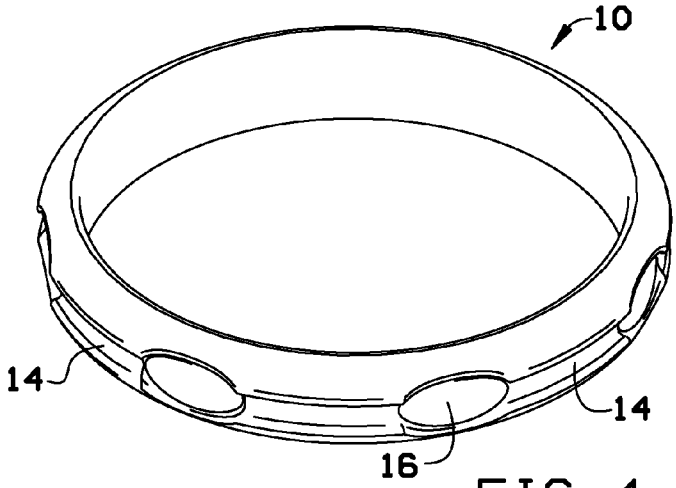
FIG. 4 is a perspective view of an alternate embodiment of the invention.
Figure 5:
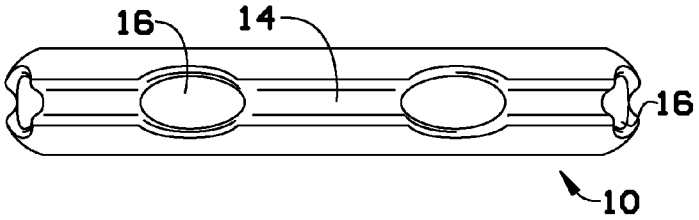
FIG. 5 is a front view of an alternate embodiment of the invention.

The following detailed description is of the best currently contemplated modes of carrying out exemplary embodiments of the invention. The description is not to be taken in a limiting sense, but is made merely for the purpose of illustrating the general principles of the invention.

Broadly, an embodiment of the present invention provides a bracelet having a channel groove. The bracelet has an outer side and an inner side. A channel groove is at least partially surrounding a circumference of the outer side. A hair band may fit within the channel groove.

In certain embodiments, the device may be a bracelet that may hold an elastic hair band on the outer surface so the hair band does not have to be worn directly around the wrist. The device allows a user to wear their hair band around their wrist in a more fashionable and comfortable way. The channel groove running around the circumference of the bracelet holds at least one hair band in place. In certain embodiments, spaced indents embedded around the channel groove may allow the user to easily pull the elastic band off the bracelet with their finger in order to use the hair band.

Referring to FIGS. 1 through 7, the device may be worn on a user's 20 wrist 22. The device may be a bracelet 10, 12. The bracelet 10, 12 may have a variety of dimensions. For example, the bracelet 10, 12 may be a skinny bracelet 10, a wide bracelet 12 and the like. In certain embodiments, the bracelet 10, 12 may be a bangle bracelet, and may be rigid and non-openable, with a smooth inner side, as shown. However, it is envisioned that any bracelet 10, 12 may be used and is thereby encompassed herein.

The bracelet 10, 12 may have an outer surface and an inner surface. The bracelet 10, 12 may include a channel groove 14. In certain embodiments, the channel groove 14 may at least partially surround the circumference of the outer surface. In certain embodiments, the channel groove 14 may surround a substantial portion of the circumference of the outer surface. As illustrated in the Figures, the channel groove 14 may surround the entire circumference of the outer surface.

A hair band 18, such as an elastic hair band or tie, may fit within the channel groove 14. A user 20 may place the hair band 18 in the channel groove 14 when the user 20 is not using the hair band 18 in their hair. The channel groove 14 may fit hair bands 18 of different sizes. For example, the channel groove 14 may fit thick or thin hair bands 18. In certain embodiments, the channel groove 14 may be deep enough for one or more different sized hair bands to remain within the channel groove 14. For example, the channel groove 14 may be between about 1 mm to about 7 mm deep, about 2 mm to about 6 mm deep, about 3 mm to about 5 mm deep, or about 3.5 mm to about 4 mm deep. The channel groove may have a width between about 1 mm to about 6 mm, about 2 mm to about 5 mm, or about 3 mm to about 4 mm.

Figure 6:
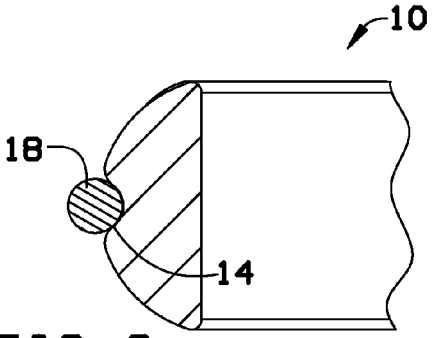
FIG. 6 is a section detail view of the invention along line 6-6 in FIG. 1.
Figure 7:
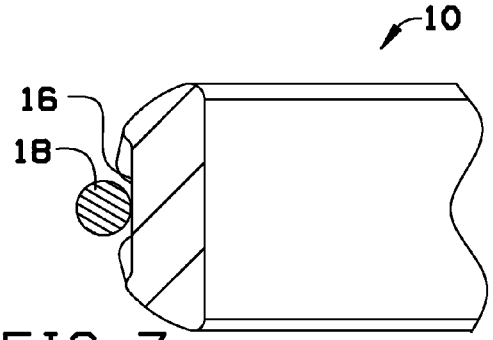
FIG. 7 is a section detail view of the invention along line 7-7 in FIG. 1.

In certain embodiments, the bracelet 10 may further include at least one indent 16. The indent 16 may be a notch or tab embedded within the outer surface of the bracelet. In certain embodiments, the indent's 16 size may correspond with a user's finger. The indent 16 surrounds the channel groove 14. For example, the indent 16 may be wider and/or deeper than the groove 14 and thereby may encompass the groove 14 and may have an arcuate boundary extending laterally from the groove as shown. The indent 16 may further form a concave surface in the outer side of the bracelet 10, while the outer surface of the bracelet 10 may be convex as shown. The indent may then extend above and below the groove 18 on the outer side of the bracelet 10, but not through an upper perimeter or lower perimeter of the outer side of the bracelet. This is illustrated in FIGS. 6 and 7. The indent may be about ⅜ th of an inch to about ⅝ th of an inch across and ½ of an inch wide. In certain embodiments, there may be a plurality of indents 16 around the outer surface of the bracelet aligned with the channel groove 14. The indent 16 allows a user 20 to easily grasp the hair band 18 when the hair band 18 is within the channel groove 14.

A method of using an embodiment of the invention is provided. First a user may take her thin or thick hair band 18 and place it around the exterior of the bracelet 10, 12. The hair band 18 may fall within the channel groove 14, thereby keeping the hair band 18 in place. When the user is ready to use the hair band 18, the user may remove the hair band 18 from the bracelet by placing their finger in the at least one indent 16 and pulling the hair band 18 off of the bracelet 10, 12. However, in certain embodiments, the bracelet 10, 12 may be used alone as a fashion accessory, without the hair band 18.

A method of making the device may include: creating a channel running around the circumference of the outer side of the bracelet by cutting the channel out of an already made bracelet or creating a mold of a bracelet with a channel. The indent could be formed, similarly, by cutting into a premade bracelet and/or molding a bracelet an indent.

It should be understood, of course, that the foregoing relates to exemplary embodiments of the invention and that modifications may be made without departing from the spirit and scope of the invention as set forth in the following claims.

What is claimed is:

1. A device comprising:

a rigid, non-openable bracelet for wearing on a wrist and having an outer side and an inner side, wherein said outer side is configured to face away from a wrist and said inner side is smooth and configured to face towards a wrist;

a channel groove formed in said outer side of the bracelet and at least partially extending along a circumference of said outer side of said bracelet, wherein the channel groove is substantially parallel with said circumference of said bracelet;

an elastic hair band removably securable within the channel groove; and at least one indent in the outer side of the bracelet having an arcuate boundary extending laterally from the groove, the indent sized to correspond to a human finger wherein said at least one indent has an indent depth in the bracelet that is deeper than a groove depth of said channel groove, wherein said at least one indent forms a concave surface in the outer side of the bracelet, and wherein the indent extends above and below the groove on the outer side of the bracelet, but does not extend through an upper perimeter or lower perimeter of the outer side of the bracelet.

2. The device of claim 1, wherein said channel groove extends along an entire circumference of said outer side of said bracelet.

3. The device of claim 1, wherein said outer side of said bracelet comprises a plurality of said indents.

4. The device of claim 1 wherein the arcuate boundary is fully within an outer boundary of the outer side.

5. The device of claim 1 wherein the outer side is convex.

* * * * *